United States Patent [19]

Seko

[11] Patent Number: 5,020,490

[45] Date of Patent: Jun. 4, 1991

[54] VALVE SEAT ARRANGEMENT

[75] Inventor: Hideo Seko, Gifu, Japan

[73] Assignee: Aisin Seiki Kabushiki Kaisha, Kariya, Japan

[21] Appl. No.: 467,167

[22] Filed: Jan. 19, 1990

[30] Foreign Application Priority Data

Jan. 19, 1989 [JP] Japan ..... 1-4824[U]

[51] Int. Cl.[5] ..... F01L 3/00

[52] U.S. Cl. ..... 123/188 S; 123/55 VE

[58] Field of Search ..... 123/188 S, 55 VE

[56] References Cited

U.S. PATENT DOCUMENTS

| | | | |
|---|---|---|---|
| 2,893,358 | 7/1959 | Bauer | 123/55 VE |
| 3,428,035 | 2/1969 | Stefan et al. | 123/188 S |
| 3,487,823 | 1/1970 | Tarter et al. | 251/359 |
| 4,236,495 | 12/1980 | Rosan, Jr. | 123/188 S |
| 4,346,684 | 8/1982 | Vossieck | 123/188 S |
| 4,424,953 | 1/1984 | Takagi et al. | 123/188 S |
| 4,546,737 | 10/1985 | Kazuoka et al. | 123/188 S |
| 4,570,585 | 2/1986 | Hayashi | 123/188 S |
| 4,614,172 | 9/1986 | Hayashi et al. | 1238/188 S |
| 4,688,527 | 8/1987 | Mott et al. | 123/188 S |
| 4,723,518 | 2/1988 | Kawasaki et al. | 123/188 S |
| 4,763,876 | 8/1988 | Oda et al. | 123/188 S |
| 4,933,008 | 6/1990 | Fujiki et al. | 128/188 S |

*Primary Examiner*—E. Rollins Cross

*Attorney, Agent, or Firm*—Burns, Doane, Swecker & Mathis

[57] ABSTRACT

A valve seat arrangement is provided in which a ceramic valve seat is secured to a valve seat holder. The valve seat holder is directly connected to the cylinder head of the block of the internal combustion engine between the exhaust passage and the combustion chamber of the engine. The cylinder head is made of cast aluminum. Due to the differences in the coefficient of heat of the various metals, the ceramic valve seat will be securely retained in the cylinder head.

4 Claims, 2 Drawing Sheets

VALVE SEAT ARRANGEMENT

BACKGROUND OF THE INVENTION

1. Field of the Invention

The present invention relates generally to an exhaust port for a cylinder block of an internal combustion engine. More particularly, the present invention is concerned with a seating mechanism between the exhaust port of the cylinder head of the engine block and a valve.

2. Description of the Related Art

An example of a prior art cylinder head of the engine block apparatus is shown in FIGS. 6 and 7. In FIG. 6, a cylinder head of the engine block 50 is of an internal combustion engine (not shown). A camshaft 51 is rotatably mounted in the cylinder head 50. A valve mechanism 52 is operatively connected to the camshaft 51. A valve shaft 53 is operated in accordance with the operation of the valve mechanism 52. The valve mechanism 52 includes a valve rocker arm 54, a valve stem 55, a retainer 56 and a valve spring 57. The valve shaft 53 is arranged between the valve mechanism 52 and the cylinder head 50. An exhaust conduit 58 is formed in the cylinder head 50. A valve seat 59 is arranged at the opening portion of the exhaust conduit 58. The valve seat 59 is formed of heat-resisting steel.

FIG. 7 shows a partial cross sectional view of a valve seat portion VS of FIG. 6. In FIG. 7, the valve seat 59 is snugly fitted in the cylinder head 50 by a pressing operation.

The valve camshaft 51 rotates in accordance with the operation of the internal combustion engine (not shown). Since the camshaft 51 is provided with sections formed into eccentric, cam-type shape, the valve rocker arm 54 converts a rotational motion into a reciprocating motion about the rocker arm shaft 54*a*. In accordance with the above mentioned operation, the valve stem 55 pushes down the valve shaft 53. When the valve shaft 53 is pushed down, a cylinder (not shown) and the exhaust conduit 58 communicate each other. On the other hand, when the valve shaft 53 is not pushed down the valve shaft 53 is seated to the valve seat 59.

The valve seat 59 is made of heat-resisting steel and the cylinder head 50 is made of cast aluminum. Based on the difference of the coefficient of heat expansion between the material of the valve seat 59 and the cylinder head 50, a gap may be generated between the cylinder head 50 and the valve seat 59. When the gap occurs, the valve seat 59 may separate from the cylinder head.

SUMMARY OF THE INVENTION

It is a primary object of this invention to provide a ceramic valve sealing mechanism in an internal combustion engine.

It is another object of this invention to provide an assembling structure for the ceramic valve sealing mechanism.

These objects and advantages are achieved by providing a cylinder head, a combustion chamber in the cylinder head, a valve mechanism in the cylinder head, a exhaust conduit and a valve shaft arranged between the valve mechanism and the cylinder block. The valve shaft operates to provide communication between the exhaust conduit and the combustion chamber. The cylinder head has a valve seating portion at an opening of the exhaust conduit and a valve seat which is made of ceramics is provided at the valve seating portion of the cylinder head.

Other objects, advantages and novel features of the present invention will become apparent from the following detailed description of the invention when considered in conjunction with the accompanying drawings.

DETAILED DESCRIPTION OF THE PREFERRED EMBODIMENTS

Figure 1:
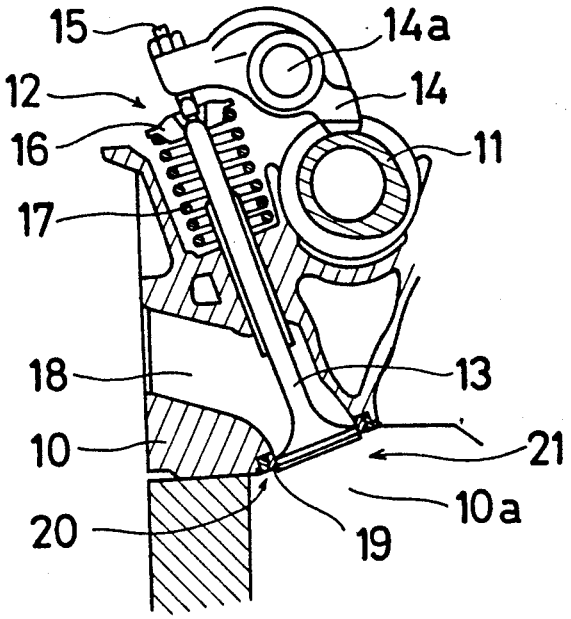
FIG. 1 represents a partial cross-sectional view of a cylinder block for an internal combustion engine according to the present invention.

FIG. 1 through 4 represent a first embodiment of the present invention. FIG. 1 represents a cylinder head of an engine portion of an internal combustion engine. Referring to the FIG. 1, a cylinder head 10 is shown as a portion of an internal combustion engine (not shown). A camshaft 11 is rotatably mounted in to the cylinder head 10. A valve mechanism 12 is operatively connected to the camshaft A valve shaft 13 is operated in accordance with the operation of the valve mechanism 12. The valve mechanism 12 includes a valve rocker arm 14, a valve stem 15, a retainer 16 and a valve spring 17. The valve shaft 13 is arranged between the valve mechanism 12 and the cylinder head 10. An exhaust conduit 18 is formed in the cylinder head 10. A valve seat 19 and a valve seat holder 20 are arranged at the opening portion of the exhaust conduit 18. In this embodiment, the valve seat 19 is made of ceramic material.

The camshaft 11 rotates in accordance with the operation of the internal combustion engine (not shown). The camshaft 11 is provided with a plurality of sections having eccentric, cam-type shapes. The valve rocker arm 14 converts rotational motion into reciprocating motion about rocker arm shaft 14*a*. In accordance with this operation, the valve stem 15 operates the valve shaft 13. When the valve shaft 13 is pushed down, a combustion chamber 10*a* and the exhaust conduit 18 communicate each other. On the other hand, when the valve shaft 13 is not pushed down, the valve shaft 13 seats against the valve seat 19.

Figure 2:
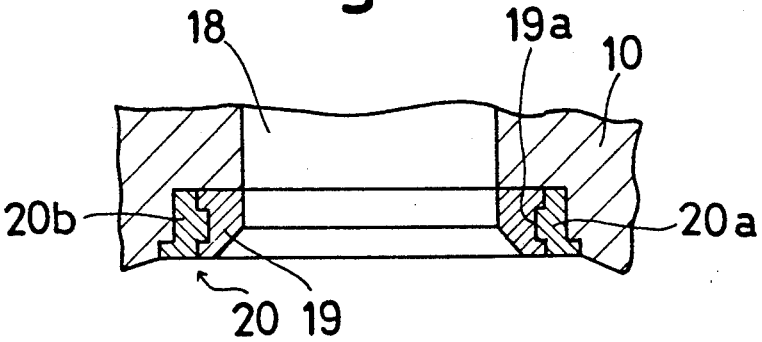
FIG. 2 represents an enlarged cross-sectional view of a valve seat portion of FIG. 1.

FIG. 2 shows a partial cross-sectional view in an enlarged scale of a valve seat portion 21 of FIG. 1. The valve seat 19 and the valve seat holder 20 are pressed into the opening portion of the exhaust conduit 18, so the valve seat 19 and the valve seat holder 20 are snugly fitted into or tightly connected to the cylinder head 10. In this first embodiment, the valve seat 19 is made of ceramic material, the cylinder head 10 is made of cast aluminum and the valve seat holder 20 is steel. The valve seat 19 is formed into a ring-shape. A groove 19*a* is formed on an outer side surface 19*b* of the valve seat 19. The groove 19*a* is formed along the entire circumference of the side surface 19*b*.

Figure 3:
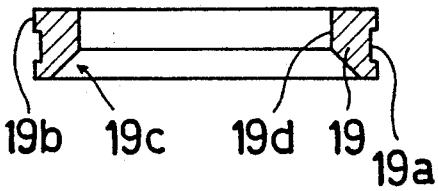
FIG. 3 represents a cross-sectional view of a first embodiment of a valve seat.

FIG. 3 shows a cross-sectional view of the valve seat 19. A taper 19*c* is formed at a lower portion of the opening portion of the valve seat 19. The angle of the taper 19*c* is formed dependent on the shape of the valve shaft 13. An opening 19*d* is formed at the center portion of the valve seat 19. The diameter of the opening 19*d* corresponds to the diameter of the exhaust conduit 18.

Figure 4:
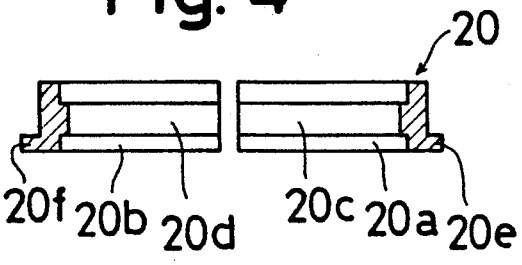
FIG. 4 represents a cross-sectional view of a first embodiment of a valve seat holder.

The valve seat holder 20 is connected to the outer periphery of the valve seat 19. The valve seat holder 20 is divided into two portions, a first valve seat holder 20*a* and a second valve holder 20*b* each of which is of a semi-circular shape (FIG. 4). Continuous projections 20*c* and 20*d* form an inner surface of the valve seat holder. At the outer periphery of the valve seat holders 20*a* and 20*b*, flanges 20*e* and 20*f* are formed. The flanges 20*e* and 20*f* connect to the opening of the cylinder head 10 leading to the exhaust conduit 18. The first valve seat holder 20*a* and the second valve seat holder 20*b* connect with the outer periphery of the valve seat 19. The continuous projections 20*c* and 20*d* connect with the groove 19*a* of the valve seat 19. The valve seat 19 and the valve seat holder 20 constitute a valve seat portion. The valve seat portion is press fitted into the cylinder head 10 under a predetermined pressure so that the valve seat portion is s fitted into or tightly fixed to the cylinder head 10.

Figure 5:
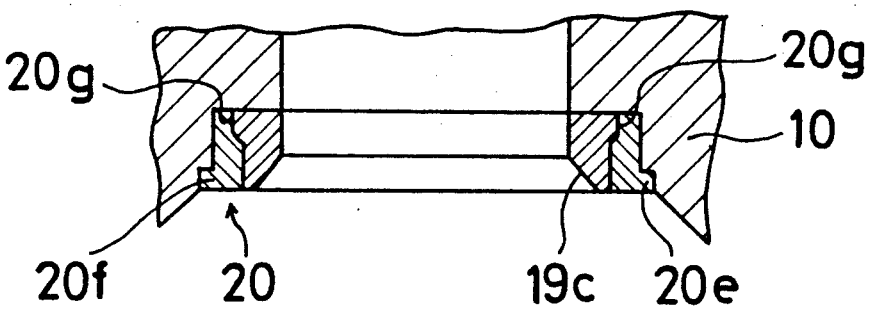
FIG. 5 represents an enlarged cross-sectional view of a second embodiment.
Figure 6:
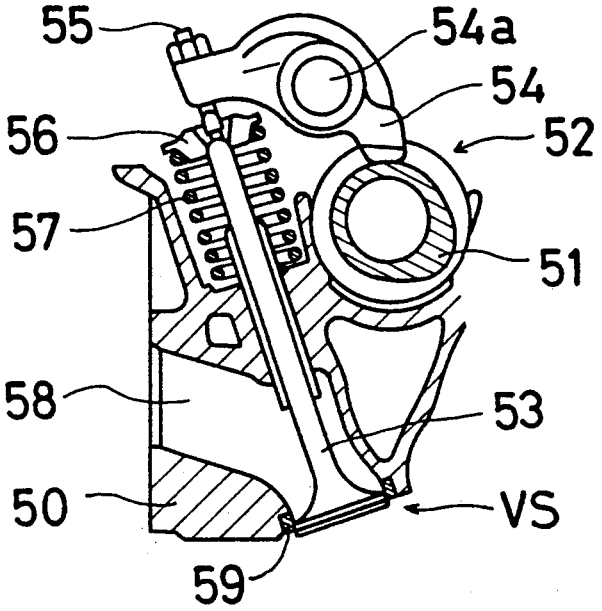
FIG. 6 represents a partial cross-sectional view of a prior art cylinder block portion of an internal combustion engine.
Figure 7:
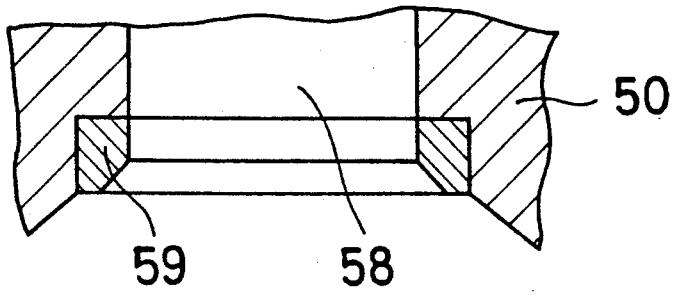
FIG. 7 represents an enlarged cross-sectional view of a valve seat portion of FIG. 6.

FIG. 5 represents a second embodiment of the present invention. A projection 19*e* is provided on the outer surface of the valve seat 19. A notch 20*g* is formed on the inner surface of the valve seat holder 20. The notch and projection cooperate to maintain the valve seat in position in the cylinder head. The valve seat holder is divided into two sections as in previous embodiments. Also, the valve seat holder is press fit into the cylinder head so that the valve seat is secured therein.

The principles, preferred embodiments and modes of operation of the present invention have been described in the foregoing application. The invention which is intended to be protected herein should not, however, be construed as limited to the particular forms disclosed, as these are to be regarded as illustrative rather than restrictive. Variations and changes may be made by those skilled in the art without departing from the spirit of the present invention. Accordingly, the foregoing detailed description should be considered exemplary in nature and not limited to the scope and spirit of the invention as set forth in the appended claims.

What is claimed is:

1. A valve seat arrangement for a combustion chamber of an internal combustion engine having an aluminum cylinder head comprising:

a valve actuating mechanism disposed in said internal combustion engine;

an exhaust conduit extending from said combustion chamber;

a valve movable between a first position for permitting communicating between said combustion chamber and said exhaust conduit and a second position blocking said communication;

a valve seat provided in said cylinder head for said valve when said valve is in said second position wherein said valve seat is made of ceramic; and a valve seat holder formed in two separate semi-circular portions, each portion having a flange in contact with the cylinder head leading to the exhaust conduit, the valve seat holder arranged between the valve seat and the cylinder head.

2. A valve seat apparatus according to claim 1, wherein the valve seat is connected with the valve seat holder by projections of said holder engaging receiving portions of said valve seat.

3. A valve seat a according to claim 1, wherein the valve seat holder is press fit into the cylinder head.

4. A valve seat apparatus according to claim 1, wherein continuous projections are formed along an inner surface of the valve seat holder so as to connect with a groove provided in the valve seat.

* * * * *